US007159853B2

(12) United States Patent
Gibbs et al.

(10) Patent No.: US 7,159,853 B2
(45) Date of Patent: Jan. 9, 2007

(54) WELDED BARRIER SYSTEM

(75) Inventors: Edward L. Gibbs, 1555 N. Mingo Rd., Tulsa, OK (US) 74116; Fred L. Givens, Tulsa, OK (US); Gary W. Vonnahme, Tulsa, OK (US)

(73) Assignee: Edward L. Gibbs, Tulsa, OK (US)

( * ) Notice: Subject to any disclaimer, the term of this patent is extended or adjusted under 35 U.S.C. 154(b) by 0 days.

(21) Appl. No.: 10/926,912

(22) Filed: Aug. 26, 2004

(65) Prior Publication Data

US 2005/0092978 A1 May 5, 2005

Related U.S. Application Data

(63) Continuation of application No. 10/140,915, filed on May 7, 2002, now Pat. No. 6,811,145.

(51) Int. Cl.
*E04H 17/16* (2006.01)

(52) U.S. Cl. ..... 256/22; 256/21; 256/65.1; 256/65.11; 256/65.12

(58) Field of Classification Search ..... 256/21, 256/22, 65.1, 65.02, 65.11, 65.12
See application file for complete search history.

(56) References Cited

U.S. PATENT DOCUMENTS

| | | | | |
|---|---|---|---|---|
| 313,825 | A * | 3/1885 | Jones | 256/65.11 |
| 895,297 | A | 8/1908 | Peter | 256/22 |
| 1,630,492 | A | 5/1927 | Kusterle | 403/270 |
| 1,782,234 | A | 11/1930 | Hofmann | 29/DIG. 48 |
| 1,906,296 | A | 5/1933 | Williams | 62/519 |
| 2,218,954 | A | 10/1940 | Gustafson | 256/22 |
| 2,482,592 | A | 9/1949 | Miller et al. | |
| 2,590,929 | A | 4/1952 | Bush | 256/22 |
| 2,909,361 | A | 10/1959 | Dotson | 256/21 |
| 3,033,532 | A | 5/1962 | McFall | 256/21 |
| 3,083,951 | A | 4/1963 | Huret | 256/65.08 |
| 3,139,504 | A | 6/1964 | Ramstein et al. | |
| 3,306,586 | A | 2/1967 | Green | 256/73 |
| 3,343,811 | A * | 9/1967 | Kusel et al. | 256/22 |
| D210,519 | S | 3/1968 | Kusel et al. | D13/7 |
| 3,385,567 | A | 5/1968 | Case et al. | 256/24 |
| 3,395,489 | A | 8/1968 | Banse | |
| 3,410,544 | A | 11/1968 | Beck | 165/169 |
| 3,517,474 | A | 6/1970 | Lanternier | 52/729.5 |
| 3,596,880 | A | 8/1971 | Greenberg | 256/65.1 |

(Continued)

FOREIGN PATENT DOCUMENTS

DE 3716343 A1 12/1988

(Continued)

OTHER PUBLICATIONS

Althouse et al., Modern Welding, The Goodheart-Willcox Co., Inc., 1997, pp. 145-148, USA.

(Continued)

*Primary Examiner*—Daniel P. Stodola
*Assistant Examiner*—Michael P. Ferguson
(74) *Attorney, Agent, or Firm*—Gary Peterson

(57) ABSTRACT

A barrier such as a fence is formed by welding conductive upright members to conductive U-shaped rails by a projection resistance welding process. The rail includes at least one weld-forming region which projects within the rail channel, and may be formed wither as a ridge, or as a longitudinally spaced series of nipple-shaped projections. The upright member is transversely positioned within the rail channel in contact with the weld-forming region. A welding current transmitted between the upright member and the rail causes the weld-forming region to at least partially melt and form a weld within the rail channel.

82 Claims, 5 Drawing Sheets

U.S. PATENT DOCUMENTS

| | | | | |
|---|---|---|---|---|
| 3,597,568 | A | 8/1971 | Rach | 219/56 |
| 3,612,291 | A | 10/1971 | Skubic | 211/208 |
| 3,648,982 | A | 3/1972 | Sabel et al. | 256/65.05 |
| 3,799,506 | A | 3/1974 | Schwartz | 256/24 |
| 4,023,683 | A | 5/1977 | Vargo | 211/192 |
| 4,174,475 | A | 11/1979 | Senn | 219/56 |
| 4,188,019 | A | 2/1980 | Meredith | 256/24 |
| 4,204,375 | A | 5/1980 | Good | 403/262 |
| 4,238,117 | A | 12/1980 | Newman | 256/65.1 |
| 4,533,121 | A | 8/1985 | Basey | 256/67 |
| D293,718 | S | 1/1988 | Poma | D25/122 |
| 4,850,214 | A | 7/1989 | Opprecht et al. | |
| 4,883,256 | A | 11/1989 | Hebda | 256/22 |
| 4,917,284 | A | 4/1990 | Candiracci | 228/5.1 |
| 4,982,933 | A | 1/1991 | Schultz | 256/65.06 |
| 4,995,591 | A | 2/1991 | Humphrey et al. | 256/34 |
| D324,506 | S | 3/1992 | Phillips | D12/155 |
| 5,136,813 | A | 8/1992 | Gibbs et al. | 49/204 |
| 5,192,054 | A * | 3/1993 | Sharp | 256/22 |
| 5,272,838 | A | 12/1993 | Gibbs | 49/404 |
| 5,345,723 | A | 9/1994 | Gibbs | 49/506 |
| 5,403,985 | A | 4/1995 | Ahn | 219/56 |
| 5,443,244 | A | 8/1995 | Gibbs | 256/22 |
| 5,927,041 | A | 7/1999 | Sedlmeier et al. | 52/730.1 |
| 6,029,954 | A | 2/2000 | Murdaca | 256/59 |
| D424,213 | S | 5/2000 | Chaney et al. | D25/122 |
| 6,073,414 | A | 6/2000 | Garris et al. | 52/694 |
| 6,176,043 | B1 | 1/2001 | Gibbs | 49/501 |
| 6,254,064 | B1 | 7/2001 | Gibbs | 256/22 |
| 6,299,143 | B1 | 10/2001 | Valentine | 256/67 |
| 6,311,957 | B1 | 11/2001 | Driscoll et al. | 256/65.05 |
| D465,856 | S | 11/2002 | Givens et al. | D25/122 |
| D466,620 | S | 12/2002 | Givens et al. | D25/122 |
| D467,669 | S | 12/2002 | Givens et al. | D25/121 |
| D468,028 | S | 12/2002 | Givens et al. | D25/121 |
| 6,519,908 | B1 | 2/2003 | Masterson et al. | 52/696 |
| 6,627,832 | B1 | 9/2003 | Vittone | 219/58 |
| 6,631,887 | B1 | 10/2003 | Walmsley | 256/22 |
| 6,648,304 | B1 | 11/2003 | Zhu | 256/22 |
| 6,739,583 | B1 | 5/2004 | Ryon | 256/65.02 |
| 6,752,385 | B1 | 6/2004 | Zen et al. | 256/56.01 |
| 6,811,145 | B1 * | 11/2004 | Gibbs et al. | 256/22 |
| 6,817,155 | B1 | 11/2004 | Larson | 52/690 |
| 6,874,767 | B1 | 4/2005 | Gibbs | |
| 6,912,787 | B1 | 7/2005 | Ruble et al. | 29/897.31 |
| 6,969,051 | B1 | 11/2005 | Gibbs | 256/56.01 |
| 7,071,439 | B1 | 7/2006 | Gibbs et al. | |
| 7,086,642 | B1 | 8/2006 | O'Brien | |
| 7,090,202 | B1 | 8/2006 | O'Brien | |
| 2003/0234391 | A1 | 12/2003 | Sheppard et al. | 256/67 |

FOREIGN PATENT DOCUMENTS

| | | |
|---|---|---|
| GB | 2093513 A1 | 9/1982 |

OTHER PUBLICATIONS

Catalog, Ameristar Aegis Ornamental Steel Residential Fencing, all pages, publication date no later than Apr. 2001.

Catalog, Ameristar Aegis II Industrial & Aegis Plus Commercial Ornamental Steel Fence and TransPort Ornamental Gates, all pages, publication date Aug. 2000.

* cited by examiner

WELDED BARRIER SYSTEM

CROSS-REFERENCE TO RELATED APPLICATION

This application is a continuation of U.S. patent application Ser. No. 10/140,915, filed May 7, 2002, now U.S. Pat. No. 6,811,145, the disclosure of which is incorporated by reference in its entirety.

FIELD OF THE INVENTION

The present invention relates generally to barriers to pedestrians or vehicles, and more particularly to fences and fence components assembled by a resistance projection welding process.

SUMMARY OF THE INVENTION

The present invention comprises a barrier formed from at least one elongate rail and at least one vertical upright member. The rail is characterized by a flat web and a pair of opposed side walls which extend from the web to define a rail channel. A weld-forming region which projects within the rail channel is formed in at least one of the side walls. The upright member is partially situated within the rail channel and is secured to the rail by a weld. The weld is formed within the rail channel at the weld-forming region, between the side-wall and the upright member.

The invention further comprises a method of assembling a barrier from at least one conductive upright member and at least one elongate conductive rail. The rail is characterized by a flat web and a pair of opposed side walls which extend from the web to define a rail channel. A weld-forming region which projects within the rail channel is formed in at least one of the side walls. The upright member is transversely positioned within the rail channel such that it contacts the weld-forming region. The upright member is contacted with an electrode having a first polarity, while the rail is contacted with an electrode having a second polarity opposed to the first polarity. A welding current is transmitted between the rail-contacting electrode and the upright member-contacting electrode to cause the weld-forming region to form a weld within the rail channel. This weld joins the upright member to the rail.

BRIEF DESCRIPTION OF THE DRAWINGS

FIG. 6 is a cross-sectional view of the rail and upright member shown in FIG. 5, in assembled form after welding has taken place.

DETAILED DESCRIPTION OF THE INVENTION

Figure 1:
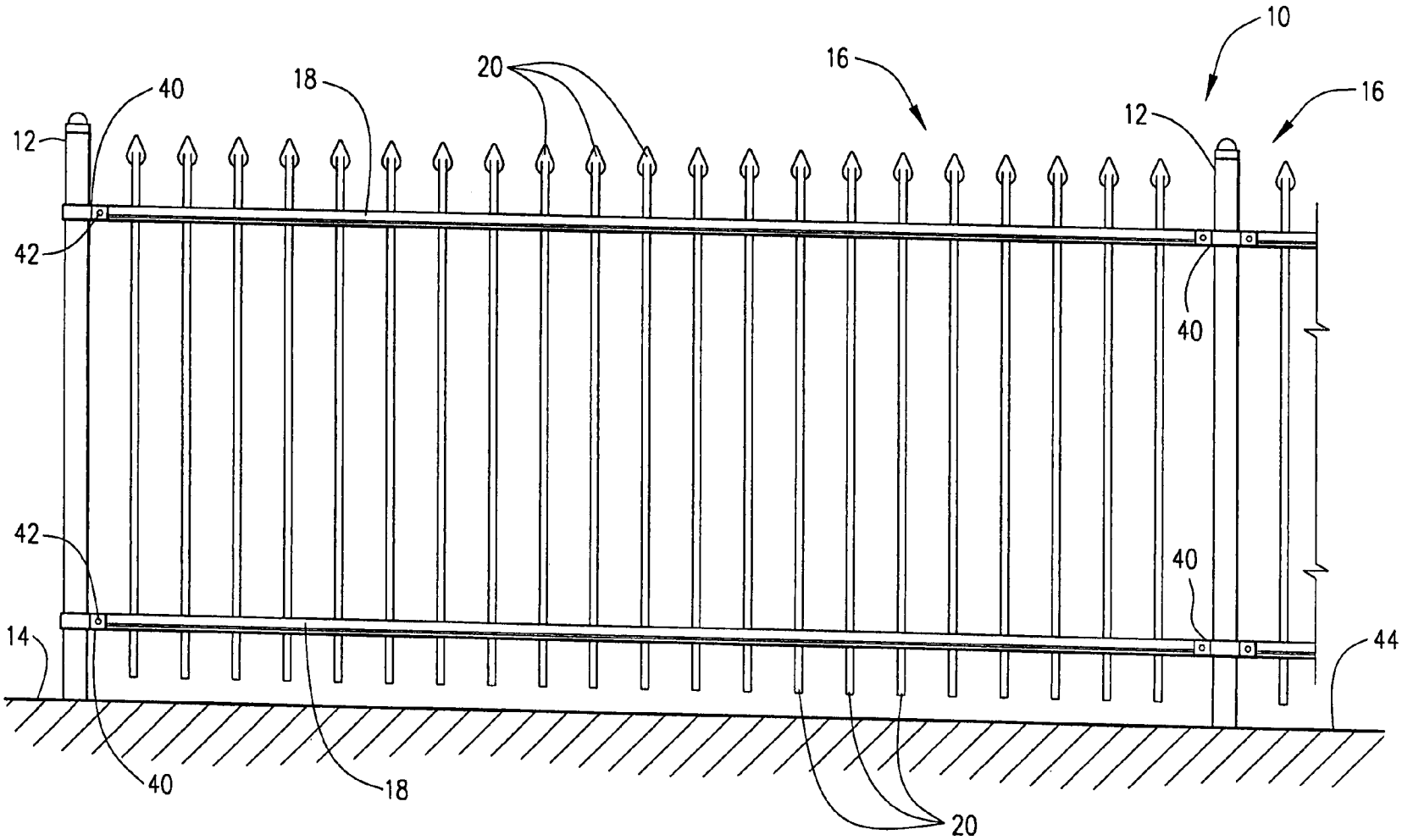
FIG. 1 is a front elevational view of a section of fence embodying the present invention, showing a panel supported between a pair of adjacent posts. The supporting terrain is shown in cross section.

The present invention comprises a barrier, such as a fence, balustrade, or gate, formed from at least one, and preferably a plurality of, elongate rails, and at least one, and preferably a plurality, of upright members. FIG. 1 shows the barrier of the present invention as embodied in a fence, generally designated by reference numeral 10.

The fence 10 preferably comprises a plurality of spaced vertical posts 12, preferably identical in construction, each of which is securely anchored at its base into a substrate 14, such as the ground, or an underground mass of concrete. The posts 12 are situated along the boundary of the area to be enclosed by the fence 10, with a post spacing which is adequate to impart strength to the fence 10 and to securely anchor other fence components. In the FIG. 1 embodiment, a post separation distance of 8 feet would be typical.

Each post 12 is preferably formed from a strong and durable material, such as sheet steel or aluminum. In a preferred embodiment of the present invention, the sheet used to form the post 12 is characterized by a thickness of 0.059 inches. In order to enhance its resistance to corrosion, the sheet is preferably subjected to a pre-galvanizing treatment. The pre-galvanized sheet is then subjected to a cold rolling process to form the rail into a tubular configuration, preferably having a rectangular cross-section. Alternately, the post may be formed with a circular cross-section. After cold rolling is complete, a polyester powder coating is preferably provided in order to further enhance corrosion resistance of the post 12.

With continued reference to FIG. 1, the fence 10 may be formed from a plurality of panels 16, each of which is supported by, and extends between, an adjacent pair of posts 12. Each panel 16 is formed from at least one rail 18, and at least one upright member 20. More preferably, each panel 16 is formed from a plurality of spaced and parallel rails 18, and a plurality of spaced and parallel upright members 20, such as the pickets shown in FIG. 1. The upright members 20 forming each panel 16 preferably extend in substantially perpendicular relationship to the rails 18 forming that panel.

Figure 7:
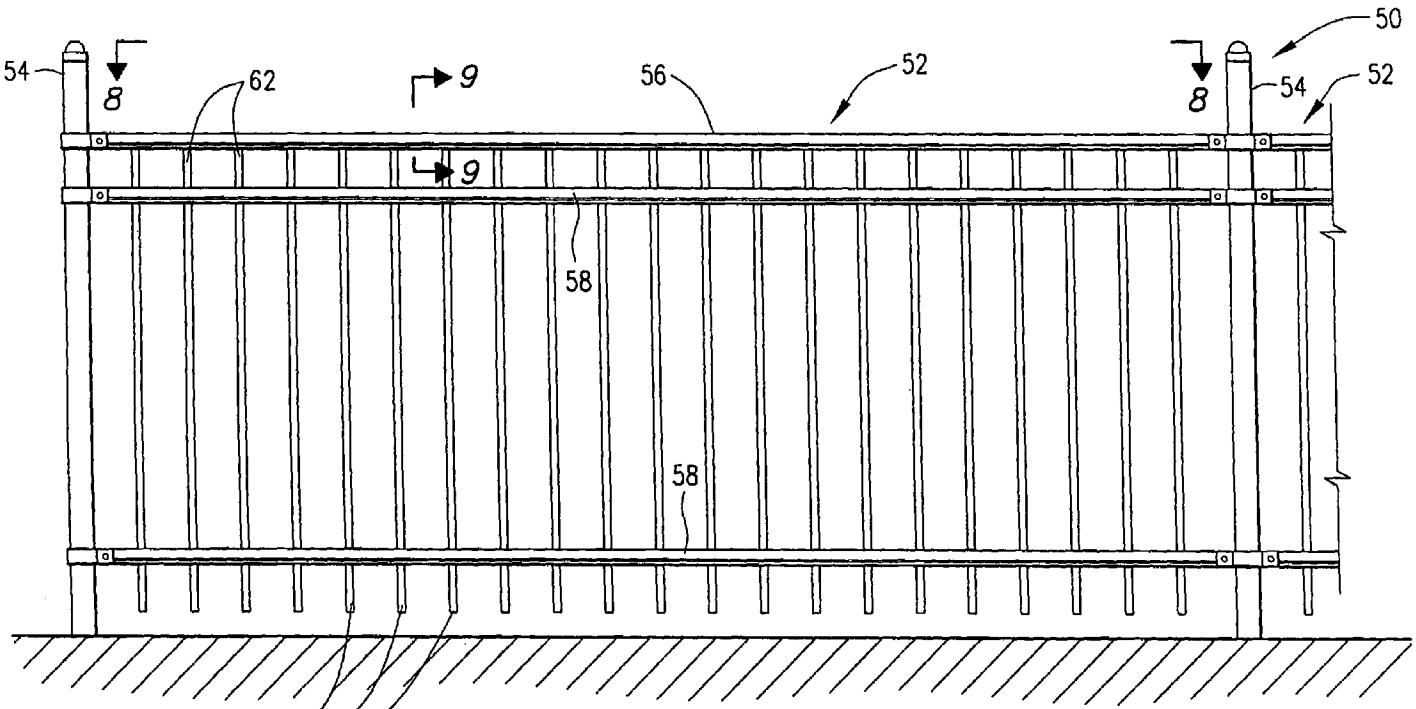
FIG. 7 is a front elevational view of a section of another type of fence embodying the present invention, showing a panel supported between a pair of adjacent posts. The supporting terrain is shown in cross section.

While any number of rails may be provided for each panel 16, either two rails, as shown in FIG. 1, or three rails, as shown in FIG. 7, are preferred. The number of upright members 20 provided for each panel 16 should be sufficiently great to assure that the separation distance between adjacent upright members 20, or between a post 12 and an adjacent upright member 20, will not permit an intruder to travel between them. For example, in a panel to be installed between posts which are separated by an 8-foot distance, twenty-one upright members may be provided, with a uniform separation distance of 4.334 inches.

Figure 2:
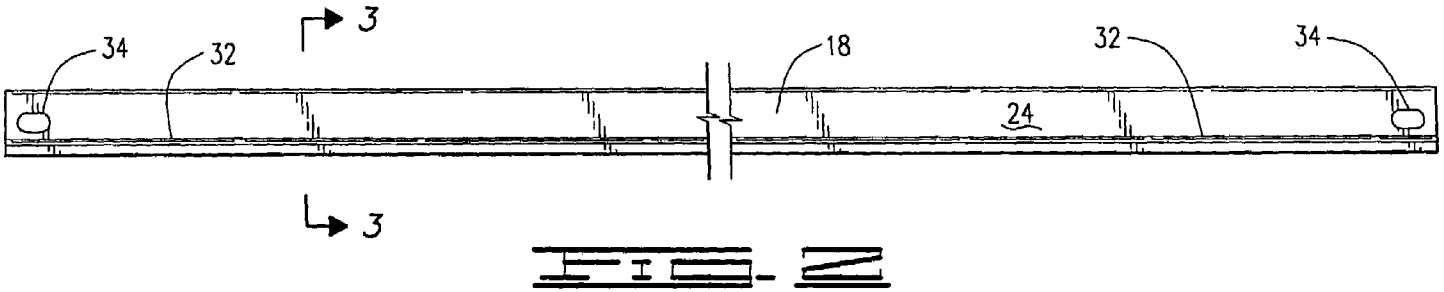
FIG. 2 is an enlarged and detailed front elevational view of one of the rails forming the panel shown in FIG. 1, prior to its assembly into the panel.
Figure 3:
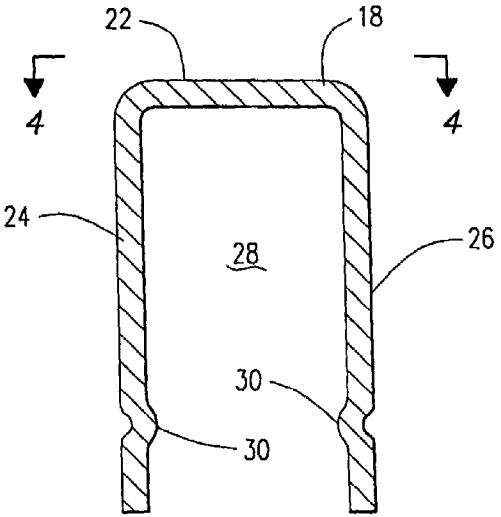
FIG. 3 is a cross-sectional view of the rail shown in FIG. 3, taken along line 3—3.
Figure 4:
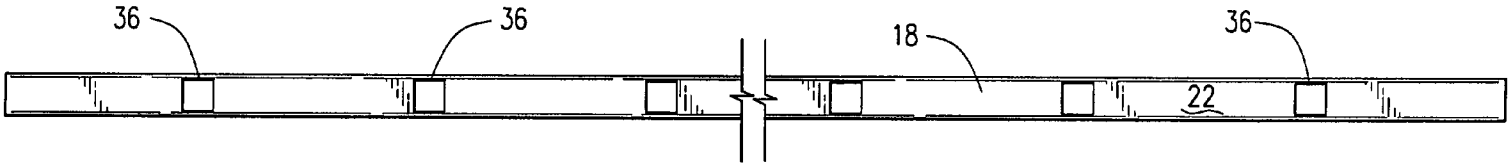
FIG. 4 is a top plan view of the rail shown in FIGS. 2 and 3, taken along line 4—4.
Figure 3:
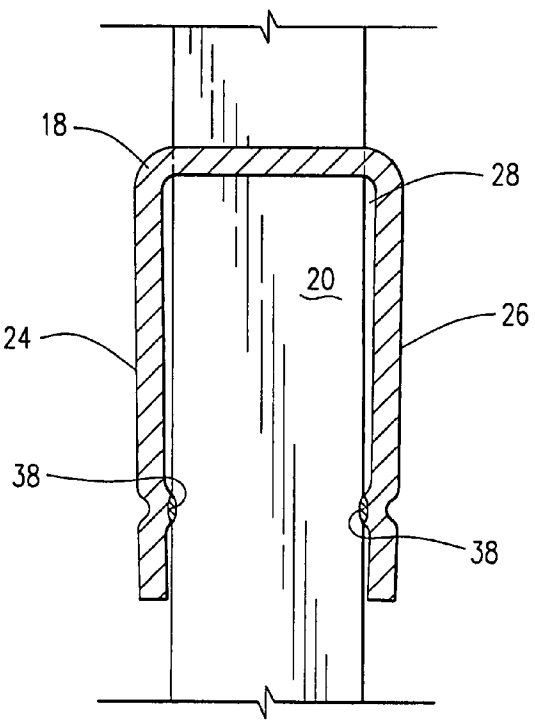

As best shown in FIGS. 2, 3 and 4, each rail 18 is characterized by an elongate flat web 22 and a pair of opposed side walls 24 and 26 which extend from the web 22. The web 22 and side walls 24 and 26 collectively define a U-shaped rail channel 28. The length of each rail 18 should be sufficient to fully span the distance between the adjacent of pair of posts 12 which will support that rail, or support the panel 16 into which the rail will be incorporated.

Each rail 18 is preferably formed from a strong, durable and conductive material, such as a sheet steel or aluminum. In a preferred embodiment of the present invention, the sheet is characterized by a thickness of 0.075 inches. In order to enhance its resistance to corrosion, the sheet is preferably subjected to a pre-galvanizing treatment. The pre-galvanized sheet is then subjected to a cold rolling process to produce the cross-sectional shape shown in FIG. 3.

At least one, and preferably both, of the side walls 24 and 26 include a weld-forming region 30 which projects within the rail channel 28. In the embodiment of the rail 18 shown in FIGS. 2, 3 and 4, a weld-forming region has been formed in each side wall. Each weld-forming region 30 may comprise a longitudinal ridge which extends along at least a portion of the length of its respective side wall, preferably in substantially parallel relationship to the longitudinal axis of the rail 18. More preferably, each ridge extends continuously along substantially the entire length of its associated side wall.

When the weld-forming regions comprise ridges, they are preferably formed during the cold rolling process. One or more continuous longitudinal scores 32 are preferably formed in the surface of the sheet which will not define the rail channel 28. These scores 32 cause ridges to protrude from the opposite surface of the sheet. When that surface is formed into the rail channel 28 by the cold rolling process, each of the protrusions will define an elongate ridge which projects within the rail channel 28 and comprises a weld-forming region 30, as shown in FIG. 2.

The dimensions of each weld-forming region 30 should be selected so that the region can effectively concentrate a welding current flow. When the rail 18 is formed from a sheet having a thickness of 0.075 inches, a preferred height for the weld-forming region 30, with respect to its associated side wall, is 0.035 inches. A preferred width for the weld-forming region 30 is 0.143 inches. A pointed and or angular profile for the weld-forming region 30 is preferred.

Opposed and aligned fastener openings 34 are formed at each of the side walls 24 and 26, preferably at each of the opposite ends of the rail 18. A plurality of longitudinally spaced top openings 36 are preferably also formed in the web 22 of at least one of the rails 18, more preferably in all of the rails 18, with the possible exception of the uppermost rail 18. In the embodiment shown in FIGS. 1–4, top openings 36 are formed in all of the rails 18. Preferably, the fastener openings 34 and top openings 36 are formed by punching from the sheet used to form the rail 18, before that sheet undergoes the cold rolling process used to form the rail 18. The top openings should be characterized by identical size and shape, which preferably is rectangular.

Each upright member 20 is preferably formed from a strong, durable and conductive material, such as sheet steel or aluminum. In a preferred embodiment of the present invention, the sheet used to form the upright member 20 is characterized by a thickness of 0.040 inches. In order to enhance its resistance to corrosion, this sheet is preferably subjected to a pre-galvanizing treatment. The pre-galvanized sheet is then subjected to a cold rolling process to form the upright member into a tubular configuration, preferably having a rectangular cross-section.

Each of the upright members 20 is preferably sized to be closely but clearingly received within the rail channel 28 of each rail 18, and to be closely but clearingly received through any top openings 36 formed in any of the rails 18 to which it will be attached. As shown in FIG. 1, the vertical height of each upright member 20 is preferably approximately equal to the above-ground vertical height of the posts 12. In the embodiment shown in FIG. 1, each upright member 20 is characterized by a substantially straight-line longitudinal axis. Alternately, each upright member may be characterized by a longitudinal axis having a lower portion which is straight, in the area of the point or points of attachment to the rail 18, and an upper portion which bends or curves away from the straight lower portion. When a plurality of upright members 20 are provided, they are preferably identical.

Figure 5:
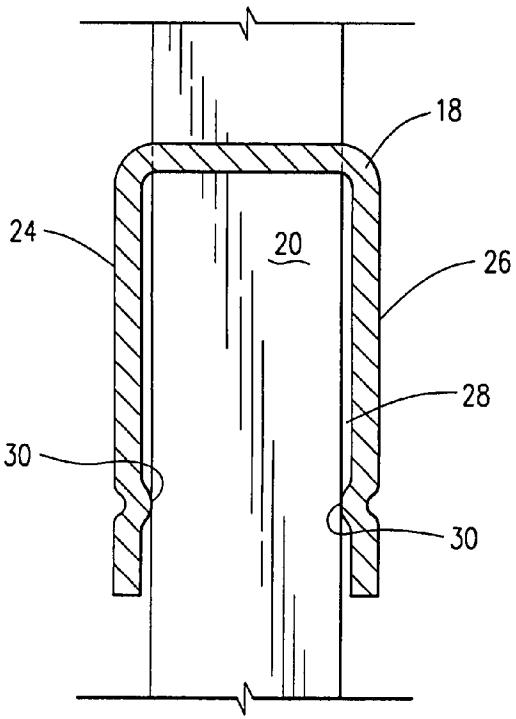
FIG. 5 is a cross-sectional view of the rail and upright member of the fence shown in FIG. 2 in a partially assembled state, prior to welding.

As shown in FIG. 5, an upright member 20 is secured to a rail 18 by transversely positioning the upright member 20 within the rail channel 28, such that the upright member 20 is partially situated within the rail channel 28 in the desired position relative to the rail 18. In this position, the upright member 20 will ordinarily extend longitudinally in substantially perpendicular relationship to the rail 18.

While positioned within the rail channel 28 as described above, the upright member 20 should contact at least one, and preferably an opposed pair, of the weld-forming regions 30 formed in the rail 18. When the rail 18 to which upright member 20 is to be secured includes top openings 36, as in FIG. 5, the upright member 20 should extended through a corresponding top opening 36 so as to fully traverse the rail channel 28.

In the next stage of assembly, the upright member 20 is contacted with a first electrode (not shown) having a first polarity, and the rail 18 is contacted with a second electrode (not shown) having a second polarity opposed to the first polarity. Preferably, the point of contact for each electrode is near the weld-forming regions 30. A welding current is then transmitted between the rail-contacting electrode and the upright member-contacting electrode.

The welding current is of sufficient of magnitude, and applied for sufficient time, so that the electrical resistance of the rail 18 causes each of the weld-forming regions 30 contacting the upright member 20 to heat up and at least partially melt. Current flow is then terminated, and the melted portions of the weld-forming regions cool to form welds 38, as shown in FIG. 6. In order to enhance the strength of the welds, the rail 18 is preferably compressed during the periods of current flow and cooling, such that each of the weld-forming regions 30 is pressed against upright member 20. The compressive force is preferably applied by the electrodes.

Each of the resulting welds 38 is situated within the rail channel 28 and joins the upright member 20 to the rail 18, resulting in a upright member-rail assembly. When the upright member 20 contacts an opposed pair of weld-forming regions 30, as shown in FIG. 6 an opposed pair of welds 38 is formed within the rail channel 28.

The source of the welding current is preferably a direct current inverter power supply, such as the model IS-471B, manufactured by Unitek Myachi Corporation of Monrovia, Calif. Such a power supply converts commercial alternating current into a high frequency direct current which is fed via a transformer to electrodes in a welding head. In one preferred embodiment, a weld current of 22,000 amperes and a frequency of 1000 Hertz is used to form the welds. Preferably 2 cycles of such a current is used to form each weld.

Additional rails 18 and upright members 20 may be attached to the welded upright member-rail assembly by repeating the steps described above, until a fence panel 16 has been formed. In each such instance, an upright member 20 will be transversely positioned within the rail channel 28 of the rail 18 to which it is to be secured, so that it contacts at least one, and preferably both, of the weld-forming regions 30. The upright member 20 is contacted with an electrode having a first polarity, and the rail 18 is contacted with an electrode having a second polarity opposed to the first polarity. While the rail 18 is undergoing compression as described above, a welding current is transmitted between the two electrodes to cause the weld-forming region to form a weld 38 within the rail channel 28 which joins the upright member 20 to the rail 18. After each panel 16 is assembled as described, it is preferably provided with a polyester powder coating in order to enhance its resistance to corrosion.

The welding steps required to assembled a panel 16 from rails 18 and upright members 20 may be performed in succession, or some or all of these steps may be performed simultaneously, preferably using a separate pair of electrodes to form each weld. For example, with the panel 16 shown in FIG. 1, seven adjacent upright members 20 may be welded simultaneously to both the upper and lower rails 18. In the case of a panel formed from twenty-one upright members 20, as in FIG. 1, the assembly process would entail three sequential welding steps, commencing from one end of the panel and proceeding to the other, with fourteen simultaneous welds being formed in each such step.

The welding steps required to form a panel 16 may advantageously be performed with automated equipment, such as a press-type welding machine. Such a welding machine may comprise one or more welding heads, each of which contains first and second electrodes which can respectively contact an upright member 20 and an associated rail 18. While current flows between the first and second electrodes, the welding machine simultaneously pressurizes the joint between the upright member 20 and rail 18. When the head is retracted, the partially assembled panel may be repositioned, so that another weld or group of welds may be formed.

With the resistance projection welding assembly method of the present invention, the welds used to assemble each panel 16 are formed internally within the rail channels 28. The exterior surfaces of the panel 16 of the present invention accordingly do not display any of the visible blemishes and marks which are characteristic of other assembly methods, such as those involving other types of welding. In addition to its role as a weld-forming region 30 within the rail channel 28, the longitudinal ridge formed in each rail 18 also enhances the strength of the rail 18.

As best shown in FIG. 1, each panel 16 is supported from an adjacent pair of posts 12 by a plurality of brackets 40, each of which is mounted on a post 12. Each bracket 40 includes fastener openings (not shown) which may be aligned with corresponding fastener openings 34 formed in each end of each rail 18. A fastener 42 is inserted through aligned openings and secured in place by a holder (not shown), such as a nut or collar. In order to maintain the rails 18 of adjacent panels in end-to-end alignment, more than one bracket 40 may be installed at same vertical position on the post 12.

When the panel 36 is installed as a fence 10, each rail 18 of the assembled fence 10 is supported at opposite ends by brackets 40 mounted on an adjacent pair of posts 12. Each rail 18 is disposed such that the channels 28 open downwardly and the side walls 24 and 26 extend substantially vertically. Within each panel 16, the incline of the rails 18 with respect to horizontal should substantially equal the incline of the terrain 44 on which pair of posts 12 supporting that panel are installed. Thus, when the fence 10 is positioned on horizontal terrain, as shown in FIG. 1, the rails 18 will be disposed substantially horizontally.

Because top openings 36 are formed in each of the rails 18 comprising the panel 16 in the embodiment of FIGS. 1–6, each of the upright members 20 projects above the highest rail and below the lowest rail of the panel. The upper end of each upright member 20 may be formed into a pointed or sharpened configuration which will deter and hinder climbing, such as a spear or spike. Alternately, upright members 20 having round or flat tops may be used. The lower end of each upright member 20 is preferably situated no more than a small distance above the terrain 44 supporting the fence 10, in order to prevent an intruder from traversing the gap between the base of the upright member 20 and the terrain 44.

FIG. 7 shows another embodiment of the barrier of the present invention, comprising a fence 50 formed from a plurality of panels 52, each of which is supported by, and extends between, an adjacent pair of posts 54. Each of the panels 52 is formed from three rails: an upper rail 54, and two lower rails 56 and 58. The lower rails 56 and 58 are identical to the rail 18 described with reference to embodiment of FIGS. 1–6.

Figure 8:
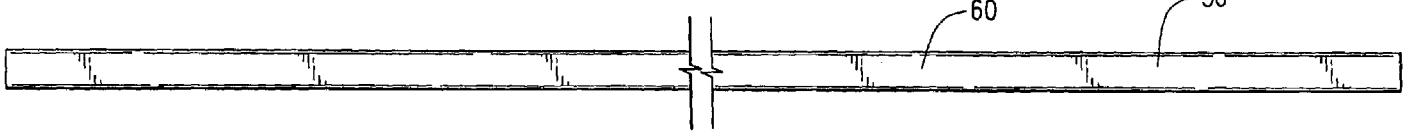
FIG. 8 is a top plan view of the upper rail of the panel shown in FIG. 7, taken along line 8—8.
Figure 9:
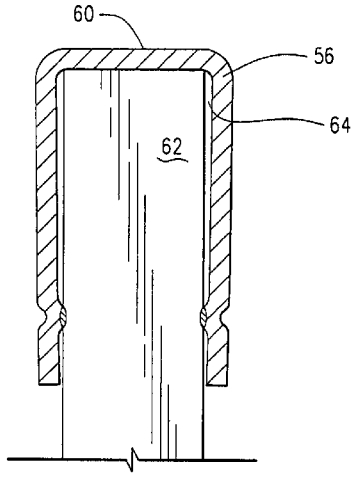
FIG. 9 is cross-sectional view of the assembled rail and upright member of the fence shown in FIGS. 7 and 8, after welding has taken place, taken along line 9—9.

With reference to FIGS. 8 and 9, the upper rail 54 forming each panel 52 is identical to the lower rails 56 and 58, except that no openings are formed in its web 60. The upright members 62 forming each panel 52 accordingly cannot extend through the web 60 of the upper rail 56, and accordingly do not project above the upper rail, as illustrated in FIG. 7. Instead each upright member 62 comprising the panel 52 terminates at its upper end within the rail channel 64 of the upper rail 56, preferably in abutment with the web 60. Aside from the differences just noted, the fence 50, panels 52, and their respective components and methods of assembly, are identical to those described with reference to the embodiment of FIG. 1-6.

Figure 10:
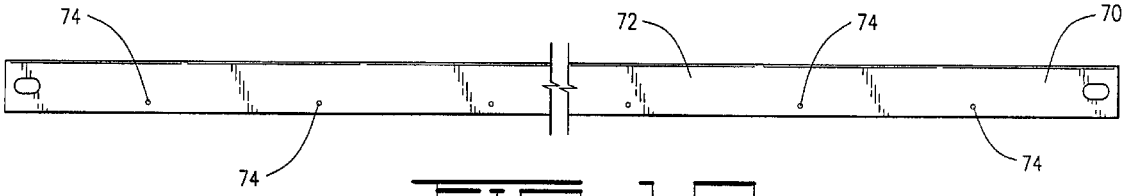
FIG. 10 is an enlarged and detailed front elevational view of another embodiment of the rail of the present invention, prior to its assembly into a fence or panel.

FIG. 10 shows another embodiment of the rail of the present invention, generally designated by reference numeral 70. The rail 70 is identical to the rail 18 described with reference to FIGS. 1 through 6, except that the weld-forming region comprises at least one, and preferably a plurality of longitudinally spaced nipple-shaped projections, rather than a continuous ridge. The cross-sectional profile of each of these nipple-shaped projections, which are preferably axially symmetrical, is the same as the cross-sectional profile of the weld-forming region 30 shown in FIG. 3. The preferred width and height of the projection are likewise the same as described with reference to FIG. 3.

Preferably, a weld-forming region comprising a plurality of longitudinally spaced nipple-shaped projections is formed in each of the side walls 72 of the rail 70. Projections formed in the respective side walls may be arranged in direct face-to-face to opposition, or the projections may be arranged in alternation, such that a projection on one side wall is disposed opposite a gap between adjacent projections in the other side wall.

The rail 70 is preferably formed from the same materials, and by substantially the same cold rolling process as described with reference to the rail 18. The only difference in the manufacturing process for the rail 70 is that no scores are impressed on the sheet during the cold rolling process, so that no ridges are formed within the rail channel. Instead, a plurality of longitudinally spaced dimple-shaped indentations 74 are formed on the sheet used to form the rail 70, preferably before commencement of the cold rolling process. If the rail 70 includes more than one weld-forming region, then a set of longitudinally spaced indentations will be formed for each such region to be formed.

The dimple-shaped indentations should be formed in the surface of the sheet which will not define the rail channel, preferably by a press punch. These dimple-shaped indentations 74 cause nipple-shaped projection to protrude from the opposite surface of the sheet. When that surface is formed into the rail channel by the cold rolling process, each of these protrusions will define a nipple-shaped projection which projects within the rail channel and comprises a weld-forming region. The resulting rail 70 may be used, with or without top openings in the web, in any of the barriers of the present invention, such as panels 16 and 52, and fences 10 and 50.

While the present invention has been described with reference to fences, and methods for their assembly, it should be understood that the invention is equally adaptable to any barrier formed from one or more rails and one or more upright member. Other types of barriers which can be formed in accordance with the present invention include balustrades, hand rail systems, guard rail systems, and gates. When the barrier of the present incorporates a hand rail, the upper rail of the preferably includes no top openings, so that the upper rail presents a smooth and regular surface suitable for gripping by a hand.

Changes may be made in the construction, operation and arrangement of the various parts, elements, steps and procedures described herein without departing from the spirit and scope of the invention as defined in the following claims.

The invention claimed is:

1. A barrier comprising:

at least one elongate rail having opposed ends, comprising:

a web; and a pair of opposed side walls extending from the web to define a rail channel, between the side walls with at least one of the side walls having a weld-forming projection which projects within the rail channel, in which the rail is further characterized as having at least one opening sized to receive a fastener formed adjacent each end of the rail; and at least one vertical upright member partially situated within the rail channel and secured to the rail by a weld formed within the rail channel between the side wall and the upright member at the weld-forming projection.

2. The barrier of claim 1 in which the web is characterized by an opening formed therein, and in which the upright member traverses the rail channel and extends through the opening.

3. The barrier of claim 1 in which the barrier comprises a plurality of laterally spaced vertical upright members, with each upright member partially situated within the rail channel and secured to the rail by a weld formed within the rail channel between the side wall and the upright member at the weld-forming projection.

4. The barrier of claim 3 in which the web is characterized as having a plurality of longitudinally spaced openings formed therein, equal in number to the number of upright members, and in which each upright member traverses the rail channel and extends through a corresponding opening in the web.

5. The barrier of claim 1 in which each of the side walls includes a weld-forming projection which projects within the rail channel, and in which the vertical upright member is secured to the rail by a pair of welds formed within the rail channel between each side wall and the upright member at its respective weld-forming projection.

6. The barrier of claim 5 in which each weld-forming projection comprises a ridge.

7. The barrier of claim 6 in which each weld-forming projection comprises a linear ridge.

8. The barrier of claim 7 in which each weld-forming projection comprises a rectilinear ridge.

9. The barrier of claim 1 in which the rail and upright member are each formed from a conductive material.

10. The barrier of claim 9 in which the weld is a resistance weld.

11. The barrier of claim 1 in which the weld-forming projection comprises a ridge extending longitudinally along at least a portion of the length of a side wall, and in which the upright member comprises one of a plurality of laterally spaced upright members, each upright member transversely positioned within the rail channel in contact with the side wall at different longitudinal positions therealong, and secured to the rail by a separate weld formed at the ridge.

12. The barrier of claim 11 in which the web of the rail is characterized by a plurality of longitudinally spaced openings formed therein, and in which each upright member extends through a corresponding opening.

13. The barrier of claim 1 in which the weld-forming projection comprises a ridge.

14. The barrier of claim 13 in which the weld-forming projection comprises a linear ridge.

15. The barrier of claim 14 in which the weld-forming projection comprises a rectilinear ridge.

16. The barrier of claim 1 further characterized as a fence panel.

17. The barrier of claim 1 further characterized as a gate.

18. The barrier of claim 1 in which the barrier is characterized as having a base, and in which the channel of the rail is characterized as opening toward the base of the barrier.

19. A barrier comprising:

at least one elongate conductive rail adapted for incorporation into a fence, comprising:

an elongate web; and a pair of opposed first and second side walls extending from the web to define a rail channel between the side walls, the first side wall having opposed first and second surfaces, the first surface contiguous with the rail channel and having at least one projection formed thereon;

at least one conductive upright member partially situated within the rail channel and secured to the rail by a weld formed between the first surface of the first side wall and the upright member at the apex of the projection.

20. The barrier of claim 19 in which the weld is a resistance weld.

21. The barrier of claim 19 in which the rail comprises one of a plurality of rails, the rails disposed in spaced and parallel relationship, and in which the upright member comprises one of a plurality of laterally spaced upright members, with each upright member extending in transverse relationship to the plurality of rails, with a weld formed between each upright member and each rail at a corresponding projection.

22. The barrier of claim 21 in which the plurality of rails comprise:

an upper rail having no openings in a web the upper rail of sufficient size to receive an upright member; and a lower rail having a plurality of longitudinally spaced openings formed therein, each opening sized to clearingly receive an upright member.

23. The barrier of claim 21 in which each rail is characterized by a plurality of longitudinally spaced openings formed therein, each opening sized to clearingly receive an upright member.

24. The barrier of claim 19 in which the second side wall has opposed first and second surfaces, the first surface contiguous with the rail channel and having at least one projection formed thereon, and in which the upright member is secured to the first surface of the second side wall by at least one weld formed at the projection.

25. The barrier of claim 24 in which the projection formed in each side wall comprises a ridge.

26. The barrier of claim 25 in which each projection comprises a linear ridge.

27. The barrier of claim 26 in which each projection comprises a rectilinear ridge.

28. The barrier of claim 25 in which the ridge extends longitudinally along at least a portion of the length of the first side wall.

29. The barrier of claim 28 in which the ridge extends substantially parallel to the longitudinal axis of the rail.

30. The barrier of claim 28, in which the upright member comprises one of a plurality of laterally spaced upright members, each upright member disposed in transverse relationship to the rail and positioned to contact the first surface of the first side wall at differing longitudinal positions along the same ridge, with a separate weld formed between the upright member and the first side wall at the area of contact of the upright member with the ridge.

31. The barrier of claim 19 in which the projection comprises a ridge.

32. The barrier of claim 31 in which the projection comprises a linear ridge.

33. The barrier of claim 32 in which the projection comprises a rectilinear ridge.

34. The barrier of claim 33 in which the ridge extends longitudinally along at least a portion of the length of the first side wall.

35. The barrier of claim 34 in which the ridge extends substantially parallel to the longitudinal axis of the rail.

36. The barrier of claim 19 further characterized as a fence panel.

37. The barrier of claim 19 further characterized as a gate.

38. The barrier of claim 19 in which the rail is further characterized as having at least one opening sized to receive a fastener formed adjacent each end of the rail.

39. The barrier of claim 19 in which the barrier is characterized as having a base, and in which the channel of the rail is characterized as opening toward the base of the barrier.

40. A barrier comprising:

at least one elongate channel-shaped rail adapted for incorporation into a fence, the rail having first and second structural elements extending from a web to define a rail channel between the structural elements, the first structural element having opposed first and second surfaces, in which the first surface is contiguous to the rail channel and has at least one projection formed thereon;

an upright member disposed in transverse relationship to the rail and partially situated within the rail channel and secured to the first surface of the first structural element by at least one weld formed at the apex of the projection.

41. The barrier of claim 40 in which the rail and upright member are each formed from a conductive material.

42. The barrier of claim 40 in which the weld is a resistance weld.

43. The barrier of claim 40 in which the rail comprises one of a plurality of rails, the rails disposed in spaced and parallel relationship, and in which the upright member comprises one of a plurality of laterally spaced upright members, with each a upright member extending in transverse relationship to the plurality of rails, with a weld formed between each upright member and each rail at a corresponding projection.

44. The barrier of claim 43 in which the plurality of rails comprise:

an upper rail having no openings in a web of the upper rail of sufficient size to receive an upright member; and a lower rail having a plurality of longitudinally spaced openings formed therein, each opening sized to clearingly receive an upright member.

45. The barrier of claim 40 in which each rail is characterized by a plurality of longitudinally spaced openings formed therein, each opening sized to clearingly receive an upright member.

46. The barrier of claim 40 in which the rail is characterized as having a second structural element, spaced from the first structural element, the second structural element having opposed first and second surfaces, in which the first surface is contiguous to the rail channel and has at least one projection formed thereon, and in which the upright member is secured to the first surface of the second structural element by at least one weld formed at the projection.

47. The barrier of claim 46 in which the first and second structural elements comprise side walls of the rail, and in which the upright member is secured to the rail by a pair of welds formed between the upright member and each of the side walls.

48. The barrier of claim 46 in which the projection formed in each structural element comprises a ridge.

49. The barrier of claim 48 in which each projection comprises a linear ridge.

50. The barrier of claim 49 in which each projection comprises a rectilinear ridge.

51. The barrier of claim 48 in which the projection formed in each side wall comprises a ridge.

52. The barrier of claim 51 in which each projection comprises a linear ridge.

53. The barrier of claim 52 in which each projection comprises a rectilinear ridge.

54. The barrier of claim 51 in which the ridge extends longitudinally along at least a portion of the length of the first structural element.

55. The barrier of claim 54 in which the ridge extends substantially parallel to the longitudinal axis of the rail.

56. The barrier of claim 40 in which the first structural element comprises a side wall of the rail.

57. The barrier of claim 56 in which the projection comprises a ridge.

58. The barrier of claim 57 in which the projection comprises a linear ridge.

59. The barrier of claim 58 in which the projection comprises a rectilinear ridge.

60. The barrier of claim 57 in which the ridge extends longitudinally along at least a portion of the length of the side wall.

61. The barrier of claim 60 in which the ridge extends substantially parallel to the longitudinal axis of the rail.

62. The barrier of claim 60, in which the upright member comprises one of a plurality of laterally spaced upright members, each upright member disposed in transverse relationship to the rail and positioned to contact the first surface of the side wall at differing longitudinal positions along the same ridge, with a separate weld formed between the upright member and the side wall at its area of contact with the ridge.

63. The barrier of claim 40 in which the projection comprises a ridge.

64. The barrier of claim 63 in which the projection comprises a linear ridge.

65. The barrier of claim 64 in which the projection comprises a rectilinear ridge.

66. The barrier of claim 40 further characterized as a fence panel.

67. The barrier of claim 40 further characterized as a gate.

68. The barrier of claim 40 in which the rail is further characterized as having at least one opening sized to receive a fastener formed adjacent each end of the rail.

69. The barrier of claim 40 in which the barrier is characterized as having a base, and in which the channel of the rail is characterized as opening toward the base of the barrier.

70. A barrier comprising:

at least one elongate channel-shaped rail adapted for incorporation into a fence, the rail having first and second structural elements extending from a web to define a rail channel between the structural elements, the first structural element having opposed first and second surfaces, in which the first surface is contiguous to the rail channel;

an upright member disposed in transverse relationship to the rail and in contact with the first surface of the first structural element at an area of contact within the rail channel;

in which a projection is situated at the area of contact between the first structural element and the upright member, and further comprising:

at least one weld formed at the apex of the projection and securing the first structural element to the upright member.

71. The barrier of claim 70 in which the rail and upright member are each formed from a conductive material.

72. The barrier of claim 71 in which the weld is a resistance weld.

73. The barrier of claim 70 in which the projection comprises a ridge.

74. The barrier of claim 73 in which the projection comprises a rectilinear ridge.

75. The barrier of claim 70 in which the rail comprises one of a plurality of rails, the rails disposed in spaced and parallel relationship, and in which the upright member comprises one of a plurality of laterally spaced upright members, with each upright member extending in transverse relationship to the plurality of rails.

76. The barrier of claim 75 in which a weld is formed between the first structural element of each rail and each upright member at a projection.

77. The barrier of claim 76 in which each projection comprises a ridge.

78. The barrier of claim 76 in which each projection comprises a rectilinear ridge.

79. The barrier of claim 70 further characterized as a fence panel.

80. The barrier of claim 70 further characterized as a gate.

81. The barrier of claim 70 in which the rail is further characterized as having at least one opening sized to receive a fastener formed adjacent each end of the rail.

82. The barrier of claim 70 in which the barrier is characterized as having a base, and in which the channel of the rail is characterized as opening toward the base of the barrier.

* * * * *